United States Patent [19]

Gosney et al.

[11] 4,206,684

[45] Jun. 10, 1980

[54] HYDRAULIC JACK

[76] Inventors: John G. Gosney, 3306 Mud Lick Rd., SW., Roanoke, Va. 24108; James A. Gosney, 2000 McVitty Rd., Salem, Va. 24153

[21] Appl. No.: 887,275

[22] Filed: Mar. 16, 1978

Related U.S. Application Data

[60] Division of Ser. No. 740,203, Nov. 9, 1976, abandoned, which is a continuation-in-part of Ser. No. 607,381, Aug. 19, 1975, abandoned.

[51] Int. Cl.[2] ..... F01B 7/20

[52] U.S. Cl. ..... 91/173; 91/167 R; 91/408; 92/52; 92/53; 92/165 R; 92/167

[58] Field of Search ..... 92/52, 53, 165 R, 167, 92/51, 168; 91/407, 408, 409, 173, 167 R

[56] References Cited

U.S. PATENT DOCUMENTS

| | | | |
|---|---|---|---|
| 2,443,312 | 6/1948 | Geiger | 91/407 |
| 2,872,904 | 2/1959 | Van den Beemt | 92/52 |
| 3,053,050 | 9/1962 | Sommerer | 92/52 |
| 3,136,221 | 6/1964 | Walker | 92/53 |
| 3,333,513 | 8/1967 | Wettstein | 92/165 R |
| 3,561,331 | 2/1971 | Feucht | 92/165 R |
| 3,677,141 | 7/1972 | Lagerqvist | 91/407 |
| 3,973,468 | 8/1976 | Russell, Jr. | 92/52 |

FOREIGN PATENT DOCUMENTS

| | | | |
|---|---|---|---|
| 1038620 | 8/1966 | United Kingdom | 92/52 |

*Primary Examiner*—Abraham Hershkovitz
*Attorney, Agent, or Firm*—Beveridge, De Grandi, Kline & Lunsford

[57] ABSTRACT

A hydraulic jack suitable for powering a large load such as an elevator or a drawbridge. In a first embodiment the hydraulic jack telescopes at a uniform rate over its entire distance of extension and includes a plunger member telescopingly enclosed within a sleeve member which, in turn, is telescopingly enclosed within a cylinder member, with the cylinder member encircled by an oil jacket within which the cylinder member is capable of limited angular movement. Means are provided for angularly aligning the various members within one another. Means are also provided to restrict the flow of hydraulic fluid as the hydraulic jack reaches a limit of its travel. Hydraulic jacks in accordance with the present invention can be coupled together in systems to lift large loads.

29 Claims, 14 Drawing Figures

FIG. 1
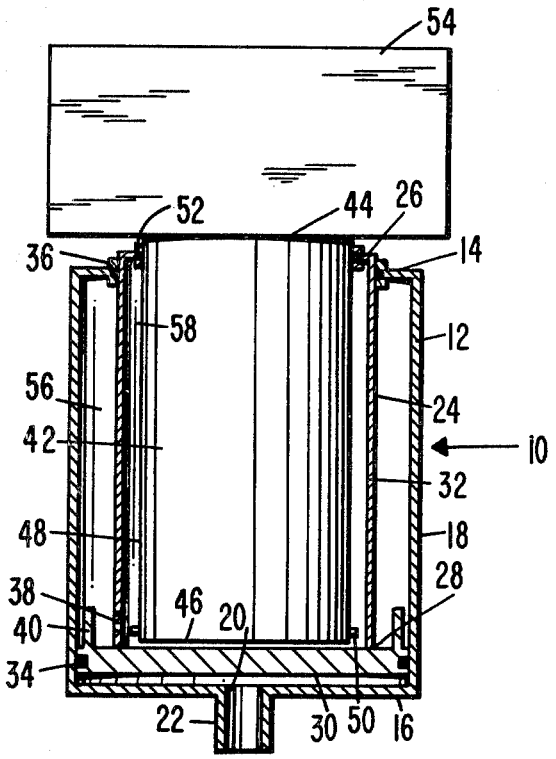
FIG. 2
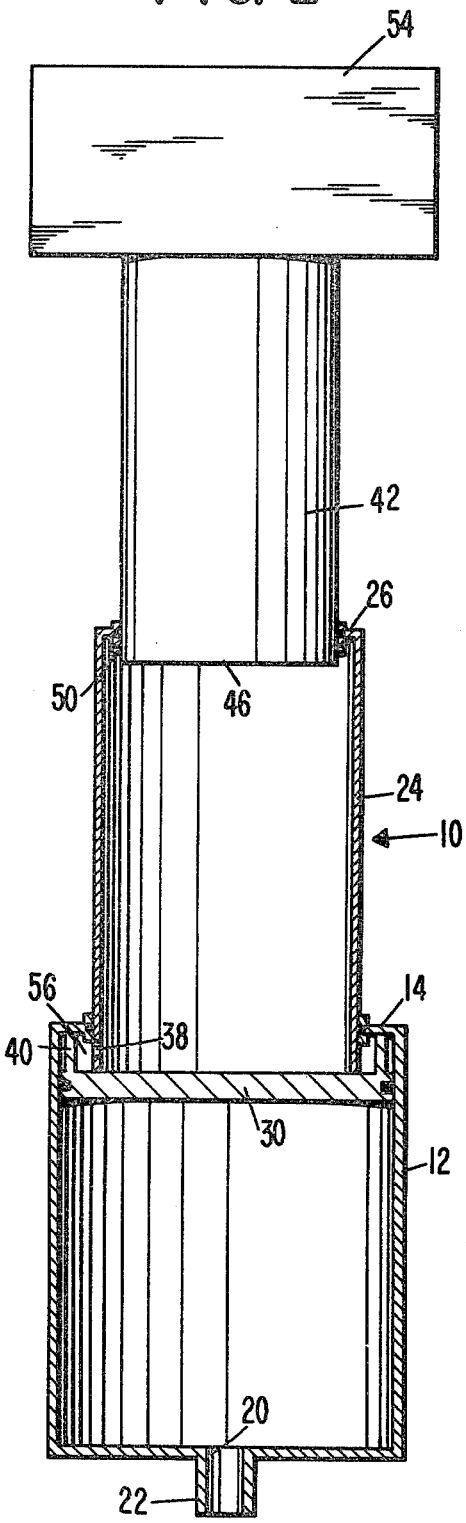
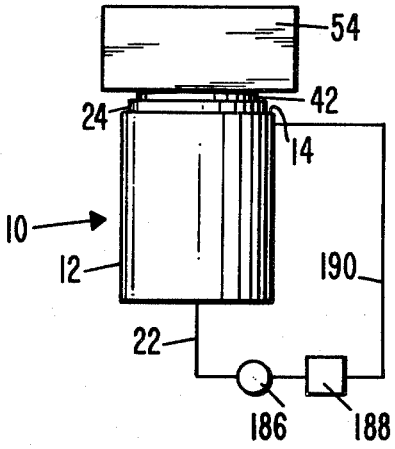
FIG. 5

FIG. 12
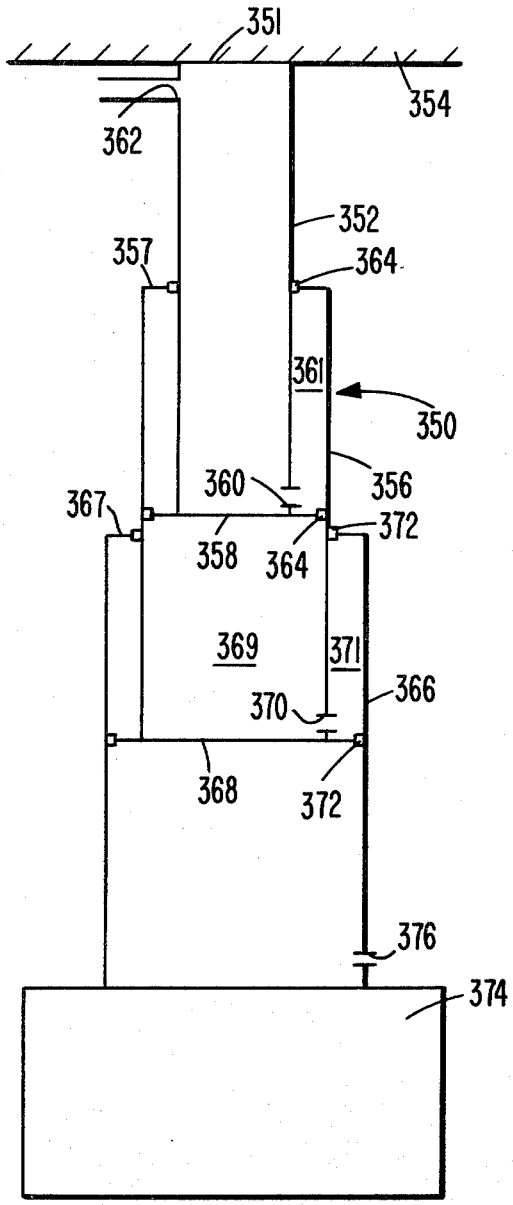
FIG. 13
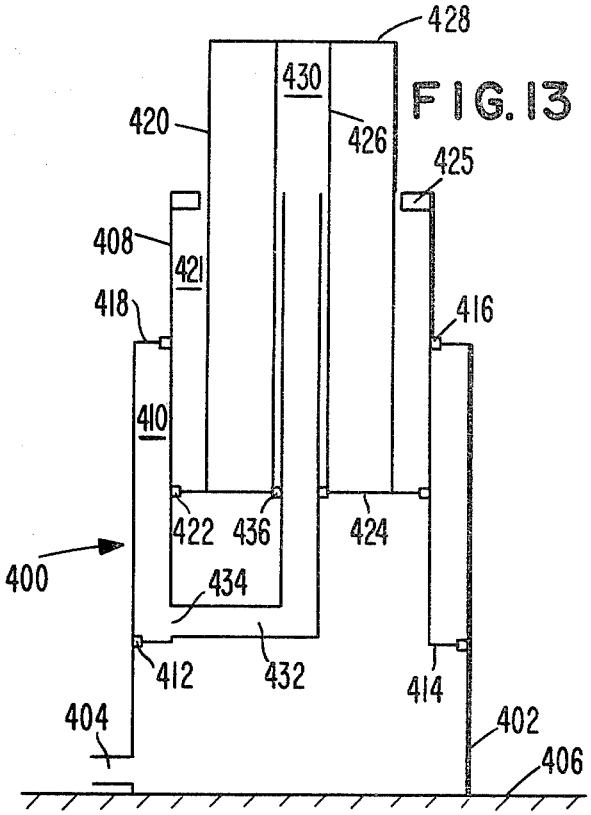
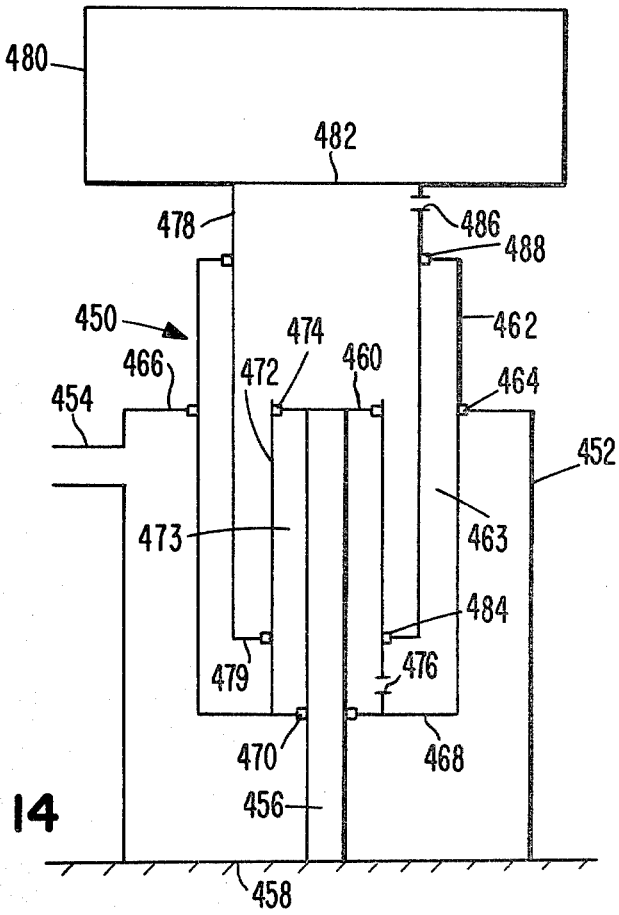
FIG. 14

HYDRAULIC JACK

This is a division of application Ser. No. 740,203 filed Nov. 9, 1976 now abandoned which was a continuation-in-part of Application Ser. No. 607,381 filed Aug. 19, 1975, and now abandoned.

The present invention pertains to telescoping hydraulic jacks and to elevators powered by such jacks. More particularly, the present invention pertains to telescoping hydraulic jacks capable of extending and retracting at a constant rate throughout the entire telescoping of the jack from the fully retracted position to the fully extended position, to the alignment and sealing of such a hydraulic jack, and to an elevator powered by such a jack.

Elevators are generally of one of two basic types, either a cable elevator in which the elevator car is suspended by cables attached to the top of the car, with the lifting force applied through these cables, or a hydraulic elevator in which the lifting force is applied to the bottom of the car by a direct acting hydraulic jack located below the car. With a cable elevator, all of the weight, both of the elevator and of its load, is borne by the building. Consequently, the building must include a large structure to support a cable elevator. A hydraulic elevator, however, is supported from beneath, by the hydraulic jack. The building, therefore, only needs to be capable of preventing the elevator from swaying. Consequently, installation of a hydraulic elevator is generally less expensive, particularly when the saving in construction of the building is considered. In addition, hydraulic elevators are generally considered safe, since there is no danger of the elevator dropping due to a broken cable.

In a hydraulic elevator when the hydraulic jack retracts to lower the elevator, the jack extends downwardly into the ground below the bottom landing served by the elevator. In conventional hydraulic elevators, the jack does not telescope, and so it must extend into the ground a distance approximately equal to the distance which the elevator car is to travel above the bottom landing. This requires the drilling of a well to receive the jack. In many cases such drilling is very expensive, and in some cases impossible, due to subterranean conditions, such as rock, water, inappropriate soil, for example quick sand, caverns, buried objects, etc. The cost of this drilling increases as a mathematical power of the well depth increases.

Heretofore, telescoping hydraulic jacks have not been used with hydraulic elevators. To a great extent this is because of the sudden and abrupt change of velocity of the plunger of a telescoping hydraulic jack as each successive stage is employed. This abrupt change in velocity results in a bump in the ride of the elevator car, with resultant shock to passangers or objects in the car. Such a velocity change would occur in each direction of travel, and this has been the primary thing precluding the use of telescoping hydraulic jacks for elevator service.

U.S. Pat. Nos. 2,891,635, 3,252,547, and 3,292,500 show hydraulic jack-actuated elevators of the type generally found in use heretofore. U.S. Pat. No. 3,128,674 discloses a multiple stage telescopic cylinder in which constant speed of extension appears to be achieved. However, that device requires application of hydraulic fluid through several inlets simultaneously, with complex control of the rate of application of that fluid to assure that the rate of extension remains constant. Because of this, the device is not well suited for use with a hydraulic elevator. U.S. Pat. No. 3,610,100 shows a telescopic actuator which likewise requires application of fluid through multiple inlet ports, with resulting difficulty in control of the ratio of fluid to assure constant rate of extension. U.S. Pat. Nos. 2,659,348 and 3,181,436 additionally show hydraulic actuators of various types, none of which overcome the problems of known telescoping hydraulic jacks which makes such jacks unsuitable for use with elevators. U.S. Pat. No. 191,516 shows a telescoping hydraulic jack, and Great Britain Pat. No. 1,038,620 shows a telescopic hydraulic ram, and each of these appears capable of constant speed of extension; however, in each case practical problems exist which make the device unsuitable for use in an elevator installation.

The present invention is a telescoping hydraulic jack having a constant rate of extension and retraction over its entire length of operation and having improved alignment and sealing characteristics. In a second aspect, the present invention is a hydraulic elevator actuated by such a jack. In accordance with a first aspect of the present invention, a plunger is telescopingly enclosed within a sleeve which, in turn, is telescopingly enclosed within a cylinder. A piston connected with the sleeve sealingly engages the cylinder sidewall. A fluid port coupled to a pump permits fluid communication with the cylinder interior beneath the sleeve piston. A fluid port through the sleeve sidewall permits fluid communication between the interior of the sleeve and the portion of the cylinder interior which is outside the sleeve and above the piston. Consequently, as fluid is introduced by the pump into the cylinder beneath the piston through the cylinder fluid port, the sleeve piston is extended, reducing the volume of that portion of the cylinder interior which is outside the sleeve and above the piston. Fluid from within that location passes through the sleeve sidewall fluid port to the interior of the sleeve within which it acts against the plunger to extend the plunger.

In accordance with another aspect of the present invention, the hydraulic jack cylinder is within a jacket and fluid ports are provided through the cylinder beneath the sleeve. Therefore, as hydraulic fluid is introduced by a pump into the jacket, the fluid passes to the cylinder interior to actuate the jack. The jacket allows the hydraulic fluid to be introduced adjacent the top of the jack and to enter the bottom of the cylinder without a flexible connection, thereby easing maintenance after installation. Additionally, the jacket permits the cylinder and related assembly to swing freely in any direction to align itself as required. Further, because the cylinder exterior is subjected to pressure from the hydraulic fluid and its pump, the net pressure to which the cylinder is subjected is lessened thereby allowing a thinner walled cylinder to be utilized.

The sealing and alignment characteristics of the telescoping hydraulic jack of the present invention make the jack self-aligning once it is installed so that any shift of alignment, which might occur due to such things as settling of a building in which is installed an elevator powered by the hydraulic jack, do not result in the jack becoming inoperative due to binding.

When a jack in accordance the present invention is incorporated into an elevator, the elevator can be raised or lowered over its entire height with no change in speed. Because the hydraulic jack telescopes, the well required beneath the bottom elevator landing surface is considerably shortened. Among other uses this telescoping makes possible use of the hydraulic elevator, with accompanying advantages, in taller buildings than otherwise possible.

These and other aspects and advantages of the present invention are more apparent in the following detailed description and claims, particularly when considered in conjunction with the accompanying drawings in which like parts bear like reference numerals.

In the drawings:

FIG. 1 is a diagrammatic representation of a telescoping hydraulic jack in accordance with the present invention and having two stages shown in the retracted position;

FIG. 2 is a diagrammatic representation of the two-stage telescoping hydraulic jack of FIG. 1 in its extended position;

FIG. 5 is a schematic diagrammatic representation of a manner of operating a hydraulic elevator incorporating a telescoping hydraulic jack in accordance with the present invention;

Figure 11:
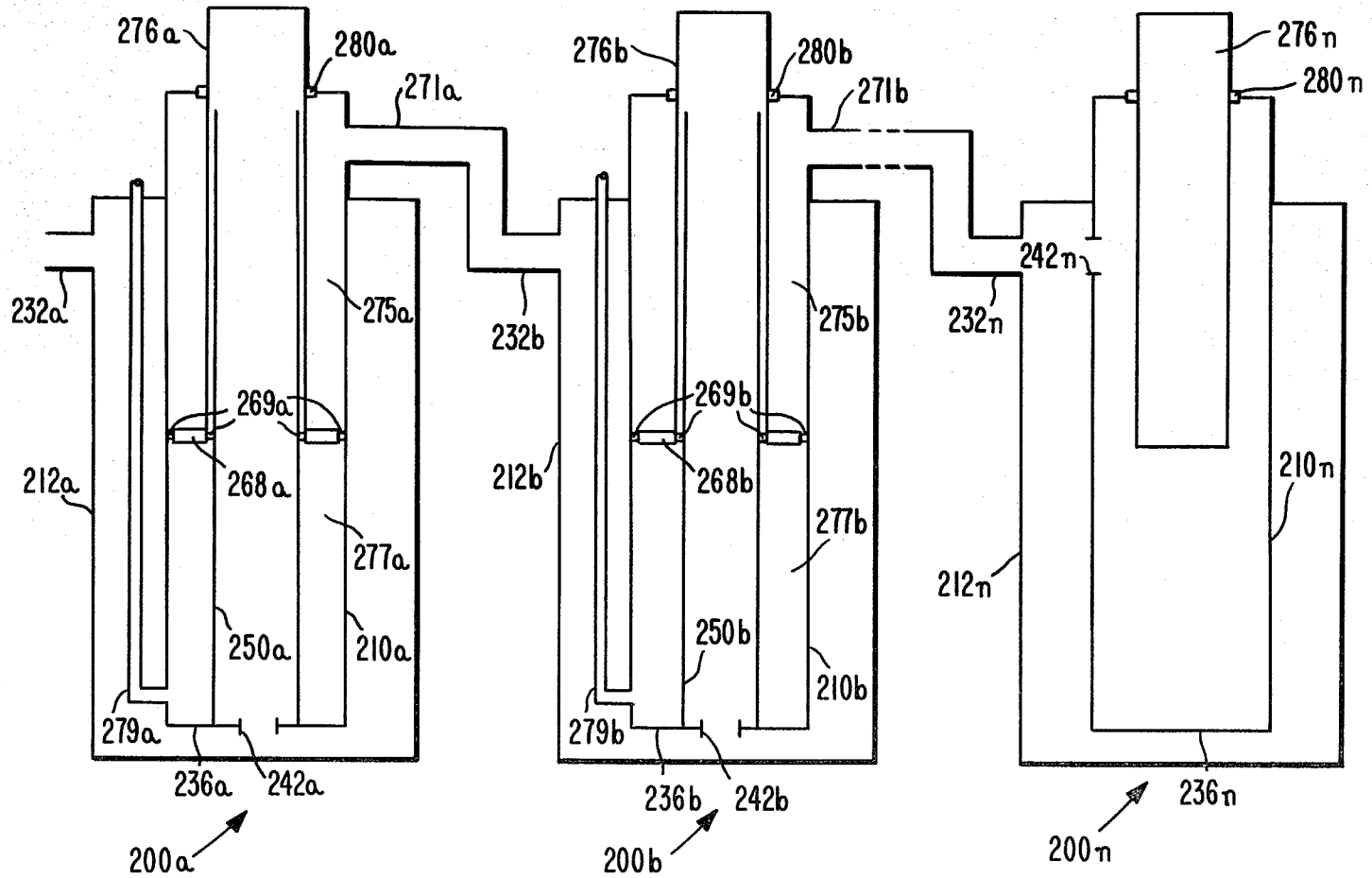

Each of FIGS. 7, 8, 9, and 10 is a fragmentary diagrammatic representation illustrating a different embodiment of a sealing mechanism suitable for use in a telescoping hydraulic jack in accordance with the present invention;

FIG. 11 is a schematic diagrammatic representation of a second embodiment of hydraulic jack system made up of a plurality of hydraulic jacks coupled for operation in tandem for elevating large loads in accordance with the present invention;

FIG. 12 is a schematic diagrammatic representation of another embodiment of a hydraulic jack in accordance with the present invention; and Each of FIGS. 13 and 14 is a schematic diagrammatic representation illustrating a further embodiment of a telescoping hydraulic jack in accordance with the present invention.

FIG. 1 depicts a telescoping hydraulic jack 10 including cylinder member 12, sleeve member 24, and plunger member 42. Cylinder member 12 includes upper surface 14, lower surface 16 and sidewall 18. Fluid port 20 is provided in lower surface 16, and fluid pipe 22 is connected therein for passage of fluid into and out of the interior of cylinder member 12.

Sleeve member 24 is telescopingly enclosed within cylinder member 12. Sleeve member 24 includes upper surface 26, lower surface 28, which is connected to piston member 30, and sidewall 32. Piston member 30 slidingly but sealingly engages the interior of sidewall 18 of cylinder member 12. Preferably, means such as sealing rings 34 are provided to assure that fluid does not pass across piston member 30. Upper surface 14 of cylinder member 18 slidingly but sealingly engages sidewall 32 of sleeve member 24. Again, preferably, a sealing ring 36 is provided to assure that fluid cannot escape from the junction of upper surface 14 and sidewall 32. A fluid port 38 is provided through sidewall 32 adjacent lower surface 28. Means such as stop member 40, which extends upwardly from piston member 30, are provided to assure that sleeve member 24 does not telescope out of the upper surface 14 of cylinder member 12 sufficiently to expose fluid port 38 above upper surface 14.

Plunger member 42 is telescopingly enclosed within sleeve member 24. Plunger member 42 includes upper surface 44, lower surface 46, and sidewall 48. Shoulder member or step ring 50 encircles sidewall 48 adjacent lower surface 46 to assure that plunger member 42 cannot telescope completely out from sleeve member 24. Upper surface 26 of sleeve member 24 slidingly but sealingly engages sidewall 48. Preferably, a sealing ring 52 is provided to assure that fluid cannot escape at that junction.

Upper surface 44 of plunger member 42 engages load 54 to be raised and lowered by hydraulic jack 10. Load 54 can be any desired load, and, by way of example, might be the car of an elevator.

Sidewall 32 of sleeve member 24 divides the interior of cylinder member 12 into an outer annular zone 56 and an inner zone 58. Preferably, cylinder member 12 and sleeve member 24 are dimensioned so that the area of upper surface 14 which is outside sleeve member 24, and thus is defined by outer zone 56, is substantially equal to the area of lower surface 46 of plunger member 42. Either upper surface 44 of lower surface 46, or both, of plunger member 42 are closed. The interior of cylinder member 12 above piston 30, both inside sleeve member 24 and outside sleeve member 24, and the interior of sleeve member 24 are filled with an incompressible fluid such as a hydraulic oil.

FIG. 1 depicts hydraulic jack 10 in its fully retracted position. When it is desired to extend hydraulic jack 10, an incompresible fluid, such as hydraulic oil, is introduced through pipe 22 and fluid port 20 beneath piston member 30. This fluid raises piston member 30, decreasing the volume within outer zone 56. The imcompressible fluid within zone 56 is thus forced through port 38 to inner zone 58 in which the fluid acts against lower surface 46 of plunger member 42 to force plunger member 42 upwardly with respect to sleeve member 24. With the portion of the area of upper surface 14 which is defined by outer zone 56 substantially equal to the area of lower surface 46, plunger member 42 extends relative to sleeve member 24 at the same rate that sleeve member 24 extends with respect to cylinder member 12. The total extension of plunger member 42 relative to cylinder member 12 continues at the same rate until either the introduction of fluid through pipe 22 is stopped or the hydraulic jack is fully extended, as depicted in FIG. 2. Preferably, plunger member 42, sleeve member 24 and its stop member 40, and cylinder member 12 are dimensioned so that in this fully extended position of FIG. 2 shoulder 50 abuts upper surface 26 of sleeve member 24, while stop member 40 abuts upper surface 14 of cylinder member 12.

When it is desired to retract hydraulic jack 10, fluid is withdrawn through port 20 and pipe 22. Consequently, piston member 30 is moved downwardly, enlarging the volume of outer zone 56. Hydraulic fluid is then drawn through port 38 from the interior of sleeve member 24. As a consequence, plunger member 46 is drawn within sleeve member 24. With that area of upper surface 14 defined by outer zone 56 substantially equal to the area of lower surface 46, plunger member 42 moves downwardly with respect to sleeve member 24 at the same rate that sleeve member 24 moves downwardly with respect to cylinder member 12. This downward movement or retraction continues at a constant rate either until fluid is no longer withdrawn through port 20 or until the hydraulic jack has reached its fully retracted condition, as depicted in FIG. 1.

Figure 3:
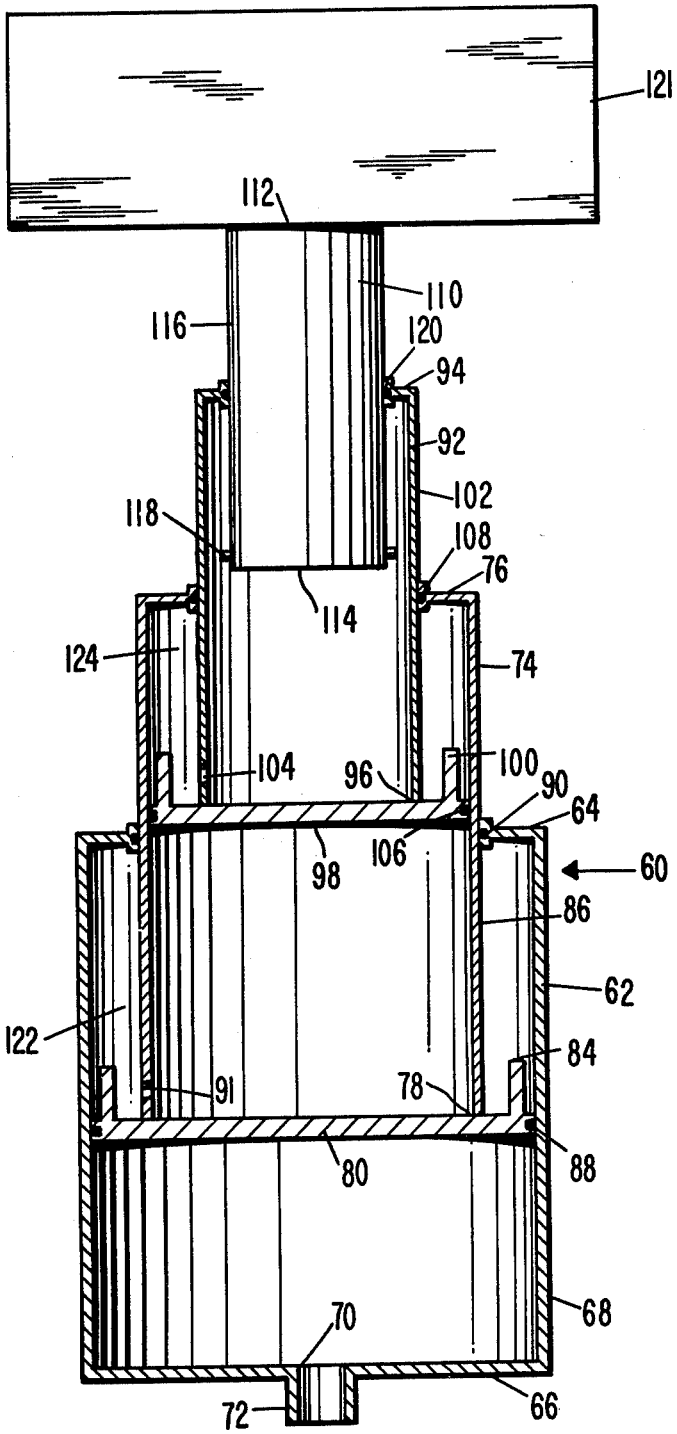
FIG. 3 is a diagrammatic representation of a three stage hydraulic jack in accordance with the present invention shown in an intermediate position.

FIG. 3 illustrates a three stage hydraulic jack which further reduces the retracted height relative to the fully extended height. Three stage hydraulic jack 60 includes cylinder member 62, first sleeve member 74, second sleeve member 92, and plunger member 110. Cylinder member 62 includes an upper surface 64, a lower surface 66, and a sidewall 68. Fluid port 70 passes through lower surface 66 to communicate with fluid inlet pipe 72. First sleeve member 74 is telescopingly enclosed within cylinder member 62 and includes upper surface 76, lower surface 78, which is connected to first piston member 80 having stop member 84 extending upwardly therefrom, and sidewall 86. Upper surface 64 of cylinder member 62 slidingly but sealingly engages sidewall 86 of first sleeve member 74. Preferably, sealing rings 88 and 90 are provided to assure that fluid does not cross piston member 80 or escape from the junction of upper surface 64 and sidewall 86. A fluid port 91 passes through sidewall 86 adjacent lower surface 78.

Second sleeve member 92 is telescopingly enclosed within first sleeve member 74 and includes upper surface 94, lower surface 96, having second piston member 98 attached thereto with stop member 100 extending upwardly from piston member 98, and sidewall 102. Fluid port 104 passes through sidewall 102 of second sleeve member 92 adjacent lower surface 96 thereof. Preferably, sealing rings 106 and 108 are provided on second sleeve member 92 to assure that fluid does not cross piston member 98 or escape from the junction of upper surface 76 and sidewall 102.

Plunger member 110 is telescopingly enclosed within second sleeve member 92 and includes upper surface 112 and lower surace 114 at least one of which is closed, and sidewall 116, with shoulder 118 encircling plunger member 110 adjacent lower surface 114. Sidewall 116 slidingly but sealing engages upper surface 94 of second sleeve member 92, and preferably the seal at that junction is assured by means of sealing ring 120. A load 121, which could be an elevator car, is supported by plunger member 110.

First sleeve member 74 can be considered an "enclosing" sleeve member in that it telescopingly encloses second sleeve member 92. Likewise, second sleeve member 92 can be considered an "enclosed" sleeve member in that it is telescopingly enclosed by first sleeve member 74.

Preferably, cylinder member 62 and first sleeve member 74 are dimensioned so that annular outer zone 122, which is within cylinder member 62, above piston member 80, and outside first sleeve member 74, defines an area on upper surface 64 substantially equal to the area of second piston member 98. Likewise, preferably, first sleeve member 74 and second sleeve member 92 are dimensioned so that annular outer zone 124, which is within first sleeve member 74 and above piston member 98 but outside second sleeve member 92, defines an area on upper surface 76 which is substantially equal to the area of lower surface 114 of plunger member 110. The interior of cylinder member 62 above piston member 80 is filled with an incompressible fluid such as a hydraulic oil. Likewise, the interior of first sleeve member 74, both below and above second piston member 98, is filled with a similar fluid, and the interior of second sleeve member 92 is filled with such a fluid.

In operation, as a hydraulic fluid is introduced through pipe 72 and fluid port 70 to the interior of cylinder member 62, first piston member 80 is raised, extending first sleeve member 74 from cylinder member 62 and decreasing the volume of outer zone 122. Consequently, the hydraulic fluid in outer zone 122 passes through fluid port 91 to the interior of sleeve 74. This raises piston 98, extending second sleeve member 92 from first sleeve member 74. The resulting reduction in the volume of outer zone 124 causes hydraulic fluid to pass through fluid port 104 to the interior of second sleeve member 92, forcing plunger member 110 to extend from second sleeve member 92. Again, with the area of that portion of upper surface 64 defined by outer zone 122 equal to the area of second piston member 98, and, with the area of that portion of upper surface 76 defined by outer zone 124 equal to the area of the lower surface 114 of plunger member 110, the various components extend at substantially the same speed; i.e., plunger member 110 extends relative to second sleeve member 92 at substantially the same rate that second sleeve member 92 extends from first sleeve member 74, and this is substantially the same as the rate at which first sleeve member 74 extends from cylinder member 62. Likewise, preferably, cylinder member 62, first sleeve member 74, second sleeve member 92, and plunger member 110 are dimensioned so that, in the fully extended position, stop member 84 abuts the underside of upper surface 64, stop member 100 abuts the underside of upper surface 76, and shoulder member 118 abuts the underside of upper surface 94.

When the three stage hydraulic jack of FIG. 3 is to be retracted, fluid is withdrawn from the interior of cylinder member 62 through fluid port 70 and pipe 72. As a consequence, first piston member 80 is drawn downwardly within cylinder member 62, enlarging the volume of outer zone 122 to draw hydraulic fluid through port 91 from the interior of first sleeve member 74. This draws second sleeve member 92 downwardly within first sleeve member 74, enlarging the volume of outer zone 124 to draw hydraulic fluid through port 104 from the interior of second sleeve member 92. As a consequence, plunger member 110 is drawn within second sleeve member 92. This retraction continues until either hydraulic fluid is no longer withdrawn through port 70 or the three stage hydraulic jack has reached its fully retracted position.

FIGS. 1-3 illustrate the telescoping jack of the present invention with particular reference to a two stage jack and a three stage jack. In a like manner, jacks of more stages could be provided in accordance with the present invention.

Figure 4:
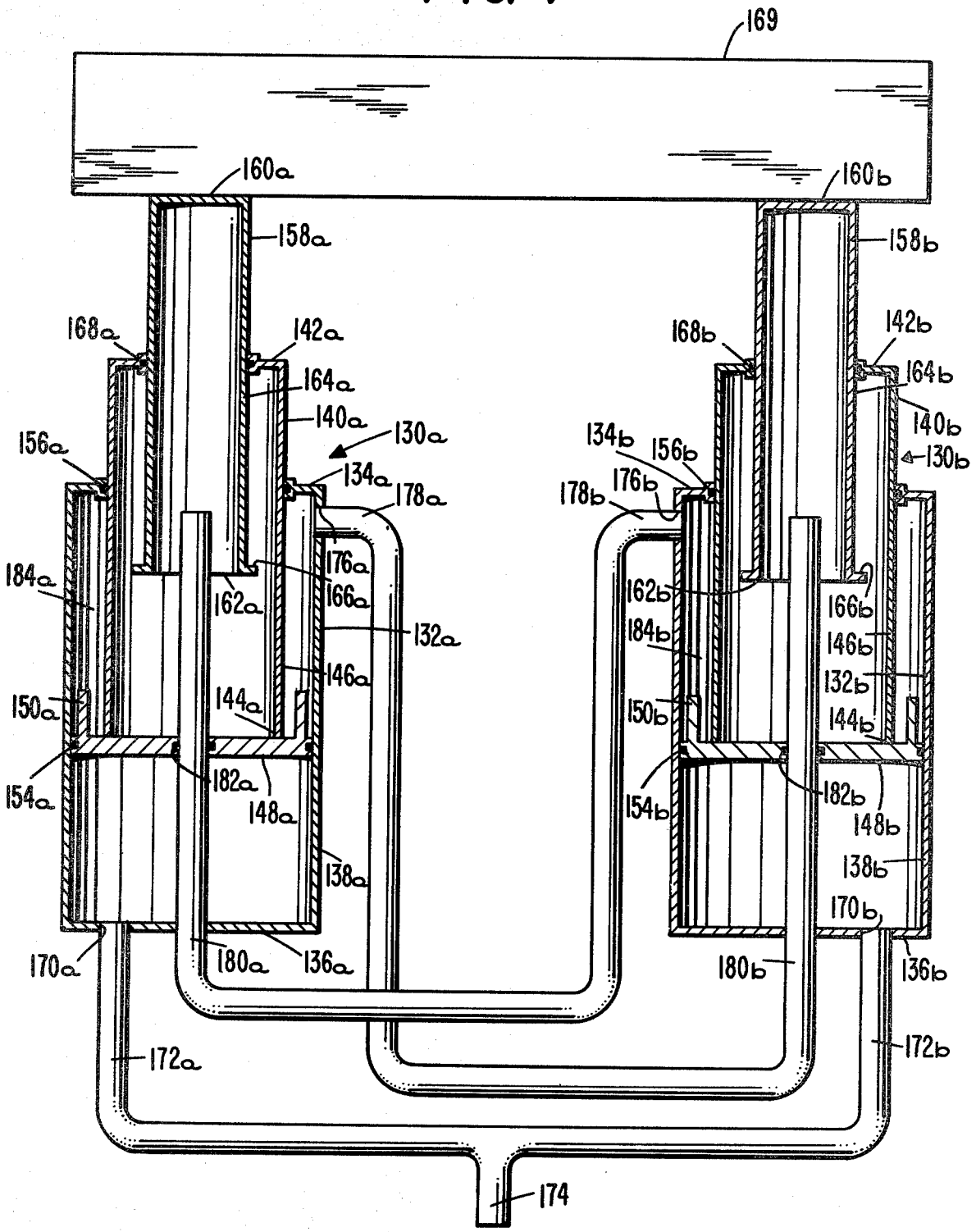
FIG. 4 is a diagrammatic representation of a first embodiment of a hydraulic jack system made up of two hydraulic jacks coupled for operation in tandem for elevating large loads in accordance with the present invention.

The hydraulic jacks illustrated by FIGS. 1-3 are suitable for raising loads of various types, including elevators, in which it is desired to have a substantially constant rate of movement, yet which are of a size such that a single hydraulic jack is sufficient for raising and lowering. FIG. 4 depicts a hydraulic lifting system including two hydraulic jacks coupled for operation in tandem in accordance with the present invention. The two hydraulic jacks depicted in FIG. 4 are substantially identical and so will be described at one time. The components of the left hydraulic jack of FIG. 4 bear reference numerals with a suffix "a", while the like components of the right hydraulic jack of FIG. 4 bear the same reference numerals but with the suffix "b". Each hydraulic jack 130 includes a cylinder member 132, a sleeve member 140, and a plunger member 158. Each cylinder member 132 has an upper surface 134, a lower surface 136, and a sidewall 138. Each sleeve member 140 is telescopingly enclosed within its respective cylinder member 132 and includes an upper surface 142, a lower surface 144, and a sidewall 146. A piston member 148 is attached to each lower surface 144 and includes a stop member 150 extending upwardly therefrom. Sealing rings 154 and 156 assure that fluid does not cross the piston members 148 or escape from the junctions of upper surfaces 134 and sleeve members 140 which slidingly but sealingly engage. Each plunger member 158 is telescopingly enclosed within its respective sleeve member 140 and includes a closed upper surface 160, an open lower surface 162, and a sidewall 164 having a shoulder 166 extending radially therefrom adjacent lower surface 162. Each sidewall 164 slidingly but sealingly engages the upper surface 142 of its associated sleeve member 140, and a sealing ring 168 assures that hydraulic fluid does not escape from that junction. A single load 169 is carried by the two plunger members **158*a* and 158*b*. Load 169** might be a draw bridge, a large elevator car, or other large load.

Each cylinder member 138 includes a fluid port 170 which is adjacent its lower surface 136 and which is connected by a fluid pipe 172 to fluid pipe 174 which is common to the two hydraulic elevators. Each cylinder member 132 also is provided with a fluid port 176 which is adjacent its upper surface 134 and which is coupled by a pipe 178 to a pipe 180 of the opposite hydraulic jack. Each pipe 180 passes through the lower surface 136 and the piston member 148 to the interior of the sleeve member 140 of that opposite jack. Preferably, each piston member 148 is provided with a sealing ring 182 which assures that fluid does not escape across the piston members 148 at the pipes 180.

When the hydraulic lifting system of FIG. 4 is to be raised, fluid is introduced through pipe 174 and the pipes 172 to the interior of each cylinder member 132. As a consequence, the piston members 148 are raised. Hydraulic fluid from outer zone **184*a* of hydraulic jack 130*a* passes out port 176*a*, through pipe 178*a*, to pipe 180*b* which passes that fluid to the interior of sleeve member 140*b* of hydraulic jack 130*b*. This extends plunger member 158*b* from sleeve member 140*b*. Likewise, hydraulic fluid from outer zone 184*b* passes through pipe 178*b* to pipe 180*a* which applies that hydraulic fluid to the interior of sleeve member 140*a* to extend plunger member 158*a* out from sleeve member 140*a*. Preferably the under surface of closed upper surface 160*a* of plunger member 158*a* is of substantially the same area as that portion of the under surface of upper surface 134*b* defined by outer zone 184*b*, and the under surface of closed upper surface 160*b* is of substantially the same area as that portion of the under surface of upper surface 134*a* defined by outer zone 184*a*, and so the plunger member 158*a* extends from its sleeve member 140*a* at the same rate as sleeve member 140*b* extends from cylinder 132*b*, while the plunger member 158*b* extends from its sleeve member 140*b* at the same rate as sleeve member 140*a* extends from cylinder member 132*a*. Ideally, these rates of extension are all the same, but, under this condition of dimensions the cross coupling assures that the total rate of extension of hydraulic jack 130*a* is substantially the same as the total rate of extension of hydraulic jack 130*b***. This cross coupled hydraulic lifting system is suitable for use with large loads, e.g., the lifting of a draw bridge.

Having the area of upper surface 14 defined by annular outer zone 56 in jack 10 of FIG. 1 equal to the area of lower surface 46 of plunger member 42 results in plunger member 42 telescoping with respect to sleeve member 24 at the same rate that sleeve member 24 telescopes with respect to cylinder 12. If desired, the ratio of these areas can be different, with a resulting difference in the rates of telescoping, so long as the lengths of plunger member 42 and sleeve member 24 are related so that plunger member 42 reaches the limit of its travel at the same time that sleeve member 24 reaches the limit of its travel.

If desired an elevator in accordance with the present invention can be installed with its plunger inactivated but available for future use. Thus, for example, if an elevator is to be installed in a building of a certain height, with the expectation that at a future date an addition will be made to the building, requiring a greater elevator height, an elevator in accordance with the present invention can be installed with its plunger initially inactivated so that the elevator initially is capable of servicing the existing height of the building, and when the addition to the building make additional elevator height necessary, the plunger can be activated to service that additional height. FIG. 5 schematically illustrates an elevator including a telescoping hydraulic jack 10, such as shown in FIGS. 1 and 2, for raising and lowering elevator car 54. The interior of cylinder member 12 is coupled by pipe 22 and pump 186 to fluid source 188 for actuation of telescoping hydraulic jack 12. Pipe 190 couples fluid source 188 with zone 56, within cylinder member 12 and adjacent upper surface 14 thereof, above piston member 30 (FIG. 1). Consequently, as hydraulic fluid is pumped from source 188 into cylinder member 12 to raise piston 30, hydraulic fluid from zone 56 above piston 30 is withdrawn through pipe 190 to source 188, and so plunger member 42 is not extended out from sleeve member 24. At the time additional building height makes the telescoping of plunger member 42 necessary, pipe 190 is removed, and its port from cylinder member 12 is capped, and the elevator operates with its plunger, just as in the embodiment of FIGS. 1 and 2.

Figure 6:
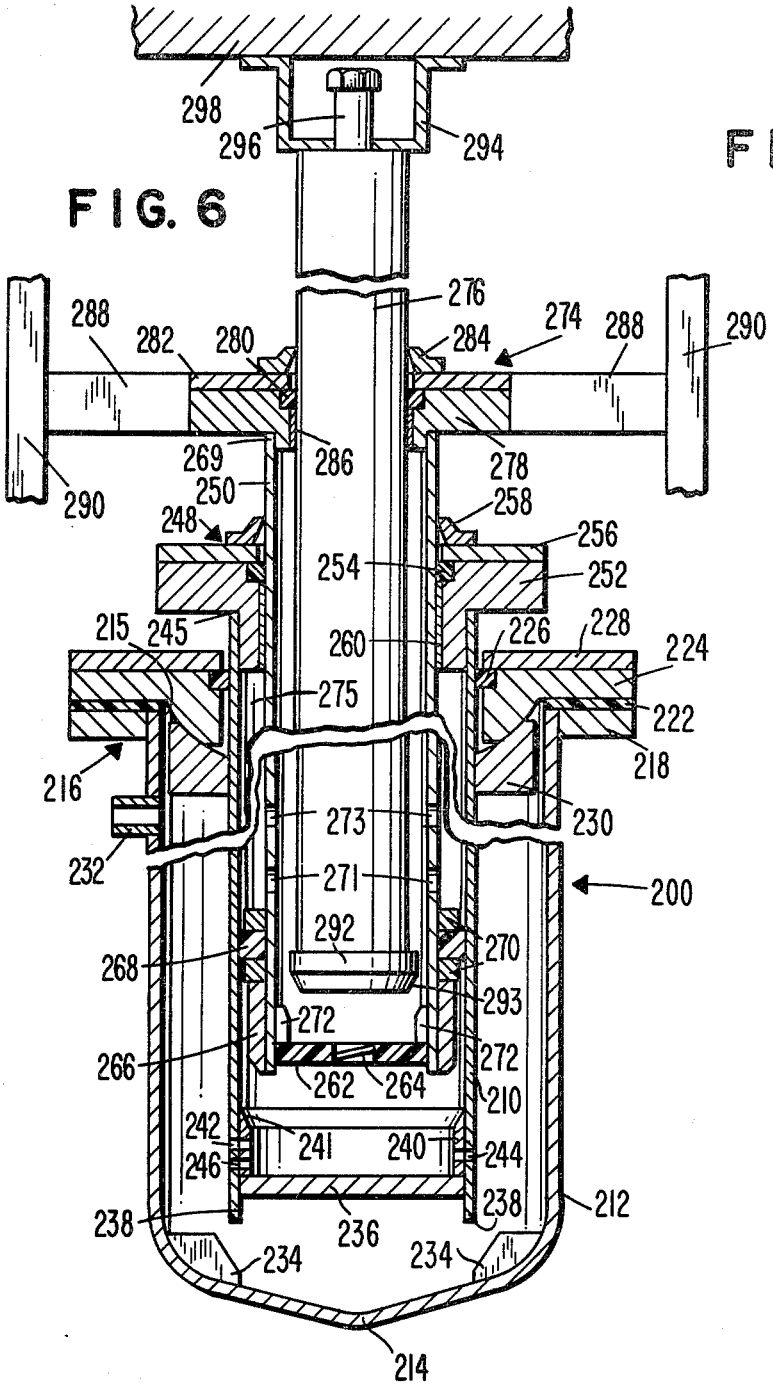
FIG. 6 is a diagrammatic representation of a hydraulic jack in accordance with the present invention depicting alignment and sealing of the various components thereof.

FIG. 6 depicts a preferred embodiment of hydraulic jack 200 in accordance with the present invention. Cylinder member 210 is encircled by oil jacket 212. Jacket 212 is a tube having a closed bottom surface 214 and an open top 215. Jacket head member 216 is attached to top 215 of jacket 212 to encirclingly engage cylinder 210. Jacket head 216 includes support ring 218, resilient gasket member 222, spherical mounting member 224, seal 226 which sealingly engages the exterior of the sidewall of cylinder 210, and seal retainer 228. Spherical seat member 230 is mounted to the exterior surface of the sidewall of cylinder 210 to engage spherical mounting member 224. Due to the facing spherical surfaces of mounting member 224 and seat member 230, spherical mounting member 224 and spherical seat member 230 cooperate to permit limited angular movement between cylinder 210 and jacket 212, i.e. limited angular displacement between the longitudinal axis of cylinder 210 and the longitudinal axis of jacket 212. Oil port 232 passes through the sidewall of jacket 212 adjacent jacket head 216. A plurality of cylinder alignment guides or ear members 234 are provided on the interior of lower surface 214 of jacket 212, e.g. three inwardly extending alignment guides 234 spaced at substantially 120° intervals around the bottom of oil jacket 212.

Cylinder 210 is an elongated tube the lower end of which is closed by plate member 236. Lip members 238 extend downwardly from the lower end of cylinder 210 beneath plate member 236. Sleeve alignment guide or alignment ring 240, in the form of a ring having a beveled upper edge 241, is positioned within cylinder 210 adjacent bottom plate 236. A first fluid port 242 passes through cylinder 210 and sleeve alignment guide 240 slightly beneath beveled upper edge 241. A second fluid port 244 passes through cylinder 210 and sleeve alignment guide 240 at a position slightly below that of port 242. A third fluid port 246 passes through cylinder 210 and sleeve alignment guide 240 at a point slightly below port 244. The upper end 245 of cylinder 210 is attached to cylinder head 248 which encirclingly engages the exterior surface of the sidewall of sleeve 250. Cylinder head 248 includes sleeve stop member 252, seal 254, seal retainer 256, and wiper 258. Preferably, a bearing surface 260 of brass or other suitable material is provided on the interior surface of sleeve stop member 252 to contact the exterior surface of the sidewall of sleeve 250.

Sleeve 250 is telescopingly enclosed within cylinder 210. Sleeve 250 is likewise an enlongated tube, the lower end of which is closed by a plate 262 which has a check valve 264 therein. The lower portion of sleeve 250 is encircled by sleeve buffer ring 266 which has an external diameter which cooperates with alignment guide 240 of cylinder 210 to properly align sleeve 250 when the sleeve is fully retracted within cylinder 210. Seal 268 slidingly seals the exterior surface of the sidewall of sleeve 250 with the interior surface of the sidewall of cylinder 210 adjacent sleeve buffer ring 266. Seal 268 is held in position by retaining members 270 positioned above and below seal 268. A plurality of plunger alignment guides 272 extend from the interior surface of the sidewall of sleeve 250 adjacent bottom member 262, e.g. three guides 272 spaced at substantially 120° around the bottom of sleeve 250. A first set of ports 271 pass through sleeve 250 just above seal 268. A second set of ports 273 pass through sleeve 250, a short distance above ports 271.

The upper end 269 of sleeve 250 is connected to sleeve head 274 which encirclingly engages the exterior surface of the sidewall of plunger 276. Sleeve head 274 includes plunger stop member 278, seal 280 which slidingly but sealingly engages plunger 276, seal retainer 282 and wiper 284. Preferably, a bearing surface 286 of brass or other suitable material is provided on the interior surface of plunger stop member 278 to contact the exterior surface of the sidewall of plunger 276. Sleeve head 274 is coupled by stablizer members 288 to slide on elevator guides 290 as sleeve 250 and plunger 276 move, thereby minimizing sway or other sideways movement of the upper portion of sleeve 250 and of plunger 276.

Plunger 276 is telescopingly enclosed within sleeve 250. The lower end of plunger 276 is provided with stop ring 292, the lower edge 293 of which is beveled to cooperate with plunger alignment guides 272 to align plunger 276 within sleeve 250 whenever plunger 276 is fully retracted within the sleeve. Preferably, the area of the bottom surface of plunger 276 is equal to the area of plunger stop member 278 defined by annular zone 275 which is between the interior surface of the sidewall of cylinder 210 and the exterior surface of the sidewall of sleeve 250 and above seal 268. Platen or mounting bracket 294 is connected to the upper end of plunger 276 by means of slip connection 296. The elevator car or other load to be raised by hydraulic jack 200 is fastened to the upper surface of mounting bracket 294.

The interior of jacket 212, the interior of cylinder 210, both above and below mounting members 270 and seal 268, and the interior of sleeve 250 are filled with a suitable incompressible fluid such as a hydraulic oil (hereinafter "oil"). When it is desired to extend telescoping hydraulic jack 200, oil is supplied through port 232 to the interior of jacket 212. As a consequence, oil passes through ports 242, 244, and 246 to the interior of cylinder 210. Since this area is already filled with oil, the oil acts to extend sleeve 250, moving sleeve 250 outwardly from cylinder 210. Therefore the volume of annular zone 275 decreases, and the oil within this zone passes through ports 271 and 273 to the interior of sleeve 250. Since this area is already filled with oil, the oil acts to extend plunger 276, moving the plunger outwardly from sleeve 250. Thus, plunger 276 extends relative to sleeve 250, and simultaneously sleeve 250 extends relative to cylinder 210. Cylinder 210, however, remains fixed relative to jacket 212. Because the cross-sectional area of annular zone 275 is equal to the area of the undersurface of plunger 276, plunger 276 extends from sleeve 250 at the same rate that sleeve 250 extends from cylinder 210. Accordingly, plunger 276 extends from cylinder 210 and jacket 212 at twice the rate that sleeve 250 extends from the cylinder and the jacket. Stop ring 292 cooperates with plunger stop member 278 to assure that plunger 276 does not extend completely out from sleeve 250. Similarly, mounting members 270 and seal 268 cooperate with sleeve stop member 252 to assure that sleeve 250 does not extend completely out from cylinder 210.

To retract hydraulic jack 200 from its extended position, oil is withdrawn through port 232 from the interior of jacket 212. As a consequence, oil passes from the interior of cylinder 210 through ports 242, 244, and 246. This retracts sleeve 250 into cylinder 210. The volume of zone 275 therefore increases, and so oil is drawn from the interior of sleeve 250 through ports 271 and 273. As a consequence, plunger 276 is retracted into sleeve 250. Again, since the cross-sectional area of annular zone 275 is equal to the area of the undersurface of plunger 276, the rate at which plunger 276 is retracted into sleeve 250 equals the rate at which sleeve 250 is retracted into cylinder 210.

Should hydraulic jack 200 be extended at its normal operating speed until stop ring 292 contacts plunger stop member 278 and/or upper retaining member 270 contacts sleeve stop member 252, the sudden stopping of the extension might result in damage to cargo or injury to people in elevator car 298. Ordinarily the hydraulic jack might be installed so that in the uppermost normal operating position of elevator car 298, jack 200 is not fully extended, thereby avoiding such a sudden stop. However, should there be a malfunction, e.g. failure of the motor to stop so that the pump continues to supply oil to port 232, elevator car 298 would be raised beyond its usual uppermost position as plunger 276 continues to extend. To assure that the speed of the extension slows prior to the action of the stops, ports 271 and 273 cooperate to act as buffers. Thus, when sleeve 250 is extended to the point at which cylinder ead 248 reduces the size of the passageway through ort 273, the flow of oil through port 273 is restricted nd eventually stopped, reducing the rate at which oil 'om zone 275 can pass to the interior of sleeve 250 and ıereby slowing the rate of extension of plunger 276. hould sleeve 250 extend to the point at which cylinder ead 248 closes port 271, the passage of oil thereırough is restricted and then stopped, and so oil can no ›nger pass from zone 275 to the interior of sleeve 250, ıus halting extension of jack 200. This halting is gradal as ports 271 and 273 are covered so that the extenon does not halt abruptly, which might otherwise ause damage to cargo within elevator 298 or injury to ersons therein.

Preferably, hydraulic jack 200 is installed so that, in s normal lowermost position, plunger 276 and sleeve 50 are not fully retracted. Thus, when utilized with an levator car, at the time the elevator car is at its lowerıost operating position, plunger 276 has its lower surıce slightly above the bottom of sleeve 250, and sleeve 50 has its lower surface slightly above the bottom of ylinder 210, as illustrated in FIG. 1. Should a malfuncon occur, e.g. failure of the (down valves to close) /ith the result that even after jack 200 has reached its ormal lowermost position oil continues to be withrawn through port 232, continued retraction of sleeve 50 and plunger 276 would occur. In such event, connued downward movement of elevator car 298 would e prevented by the car buffers (not shown) at the bot›m of the elevator shaft in the building or other strucıre in which the elevator is installed, the continued ownward movement of plunger 276 would move slip onnection 296 downwardly within bracket 294. As eeve 250 continues to retract, sleeve buffer ring 266 nters within sleeve alignment guide 240, and so port 42 is gradually covered, restricting the flow of oil /ithdrawn from the interior of cylinder 210 and thus owing the rate of retraction. Continued retraction of eeve 250 causes sleeve buffer ring 266 to gradually over port 244, further reducing the rate at which oil is /ithdrawn and thus the rate of retraction. Still contined retraction of sleeve 250 causes sleeve buffer ring 66 to gradually close port 246 so that oil no longer asses from the interior of clinder 210 to the interior of ıcket 212 and so stopping the retraction of sleeve 250 nd plunger 276. Accordingly, the cooperation of eeve buffer ring 266 and ports 240, 242 and 244 proides a buffer for the downward movement or retracon of the hydraulic jack, and so retraction is halted /ithout the sudden halt that would otherwise occur ıould sleeve 250 strike bottom plate 236 of cylinder 10 at normal operating speed and should plunger 276 :rike bottom plate 262 of sleeve 250 at normal operatıg speed.

As sleeve 250 extends from and retracts within cylinr 210, stabilizers 288 slide on elevator guides 290 to revent swaying of the elevator. Perfect alignment of levator guides 290 is difficult, if not impossible, to chieve. Likewise, maintaining of an alignment once chieved is nearly impossible due to settling and other istortion of the building or other structure. Spherical ıounting member 224 and spherical seat 230 cooperate › permit limited angular movement between jacket 212 n the one hand, and cylinder 210, sleeve 250 and lunger 276 on the other hand. Thus, minor deviations ı alignment, whether upon initial installation or subseuent, are accommodated. Gasket 222 is sufficiently :silient to permit this limited angular movement. By this means cylinder 210 is free to swing in any angular direction so that any angular misalignment between jacket 212 and the elevator guides is accommodated by swinging of cylinder 210, sleeve 250, plunger 276 and the associated components in a manner which absorbs the misalignment. Thus any tendency of the hydraulic elevator to bind on the elevator guides is overcome. Should cylinder 210 swing excessively within jacket 212, the cylinder can be realigned by simply shutting off the pump coupled to supply pipe 232 so that there is no longer sufficient pressure on the oil to retain the components in their normal position. Then cylinder 210 settles to the bottom of jacket 212, sleeve 250 settles to the bottom of cylinder 210, and plunger 276 settles to the bottom of sleeve 250. Cylinder alignment guides 234 cooperate with lip member 238 which extends from the lower end of cylinder 210 to align the cylinder to the desired extend within jacket 212, sleeve buffer ring 266 cooperates with alignment guide 240 to align sleeve 250 within cylinder 210, and stop ring 292 cooperates with alignment guides 272 to align plunger 276 within sleeve 250. Preferably, spherical mounting member 224 and spherical seat member 230 overlap by an amount sufficient to limit the angular movement between cylinder 210 and jacket 212 until alignment guides 234 and lip members 238 overlap or engage.

Should a low oil condition exist, e.g. due to a leak through seal 280, the low oil condition would be detected by a low oil detector conventionally found on hydraulic elevators, and so the pump would be shut off. The resulting reduced oil pressure within sleeve 250 permits check valve 264 to open so that additional oil can be supplied thereto when the pump is restarted. Check valve 264 then permits oil to enter sleeve 250 until the pressure within sleeve 250 exceeds the pressure outside sleeve 250 and beneath closure plate 262 by an amount sufficient to maintain plunger 276 in its quiescent position.

Figure 7:
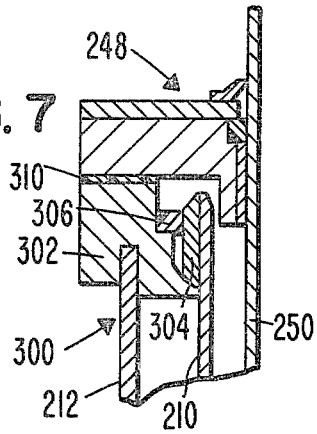

FIG. 6 depicts spherical mounting member 224 of jacket head 216 mounted on jacket 212 which remains stationary, while spherical seat member 230 is mounted on and moves with cylinder 210, beneath spherical mounting member 224. FIG. 7 depicts an alternative embodiment of jacket head 300 in which spherical seat member 302 is connected to the upper end of jacket 212, while spherical mounting member 304 is connected to the upper end of cylinder 210 and is positioned above spherical seat member 302. A seal 306 is provided to block passage of oil between spherical seat member 302 and spherical mounting member 304. Cylinder head 248 is fastened to jacket head 300 by resilient seal 310. Cylinder head 248 can be formed of two or more pieces for ease of manufacture, if desired. Likewise, jacket head 300 may be formed of two or more pieces for ease of manufacture.

Figure 8:
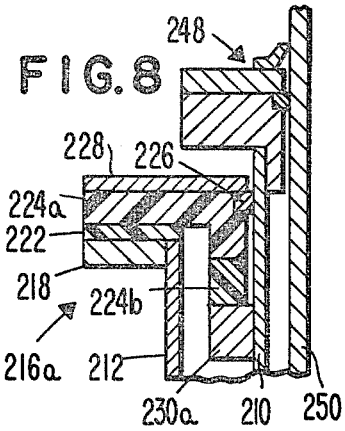

FIG. 8 depicts another form of jacket head 216*a*. Support ring 218 is attached to the upper end of jacket 212. Mounting member 224*a* is attached to support ring 218 by resilient gasket member 222. Mounting member 230*a* is attached to the outer surface of cylinder 210. Resilient member 224*b* couples mounting member 224*a* with mounting member 230*a*. Seal 226 seals mounting member 224*a* against the exterior sidewall of cylinder 210 and is held in place by seal retainer 228. Should misalignment result in a shift of cylinder 210 relative to jacket 212, resilient member 224*b* absorbs the misalignment and in this respect acts as does the cooperation of the spherical surfaces of spherical mounting member 224 and spherical seat member 230 in jacket head 216 of FIG. 6.

Figure 9:
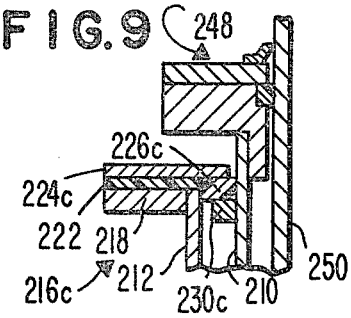
Figure 10:
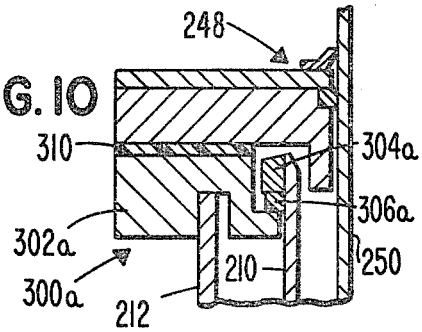

As illustrated in jacket head 216c of FIG. 9, if desired, the functions of seal 226 and of resilient member 224b can be combined to be performed by a resilient seal member 226c held between mounting member 224c and mounting member 230c. Likewise, as depicted in FIG. 10, the embodiment of FIG. 7 can be modified to provide a jacket head 300a in which resilient seal 306a serves both to seal the junction of jacket 212 and cylinder 210 and as a resilient material to absorb misalignment between jacket 212 and cylinder 210. Thus, resilient seal 306a is held between mounting members 302a and 304a which then do not require cooperating spherical surfaces.

FIG. 11 is a schematic illustration of a tandem jack system in accordance with the present invention and including jacks 200a, 200b, . . . and 200n coupled in tandem. The initial jack 200a and the intermediate jacks 200b, 200c . . . 200(n−1) are identical, and so only jack 200a will be described in detail. Each of the components of jack 200a bears a reference numeral ending in "a". In jack 200b and the other intermediate jacks the corresponding components are labeled with the same reference numeral but ending in the corresponding letter "b", "c", etc.

Fixed sleeve 250a extends upwardly from bottom member 236a of cylinder 210a. Fluid port 242a passes through bottom member 236a to provide fluid communication between the inside of fixed sleeve 250a and the outside of cylinder 210a. Plunger 276 is positioned over sleeve 250a. Piston member 268a is attached to the lower end of plunger 276a to move therewith, and seal members 269a slidingly seal the piston member 268a against the external sidewall of sleeve 250a and the internal sidewall of cylinder 210a, thus dividing the annular zone between sleeve 250a and cylinder 210a into an upper annular zone 275a and a lower annular zone 277a. Seal 280a sealingly couples the upper surface of cylinder 210a to the external sidewall of plunger 276a. Zone 277a is vented by vent 279a to the exterior of the jack 200a. If desired, a jacket 212a can enclose cylinder 210a, and in such case vent 279a vents zone 277a to the exterior of jacket 212a. Oil port 232a permits passage of oil into and out from the interior of jacket 212a. Should jacket 212a be omitted, then oil port 232a communicates directly with port 242a in bottom surface 236a of cylinder 210a. Port 271a adjacent the upper surface of cylinder 210a is coupled to port 232b of the next stage of the tandem jack system.

The terminal jack 200n of the tandem jack system is a simple hydraulic jack. Thus, as depicted in FIG. 11, plunger 276n is telescopingly enclosed within cylinder 210n with seal 280n assuring a fluid-tight seal at the junction. If it is desired that jackets be utilized then cylinder 210n is enclosed within jacket 212n, and the actuating oil is passed through port 232n to the interior of jacket 212n and then through port 242n to the interior of cylinder 210n. Port 242n might be located in the sidewall of cylinder 210n, as depicted in FIG. 11, or in the bottom surface 236n of the cylinder, as desired.

As many jack stages as desired can be utilized in the tandem arrangement. The initial stage 200a and the intermediate stages 200b, . . . 200(n−1) are identical with the port 271 of each stage connected to the port 232 of the next stage. Preferably, the area on the upper surface of the sleeve 210 defined by the annular zone 275 of any stage is equal to the area of the interior top surface of the plunger 276 of the next stage; e.g. the area of the top surface of sleeve 210a defined by annular zone 275a equals the area of the interior of the top surface of plunger 276b.

Initially the interior of fixed sleeve 250a and zone 275a are filled with an incompressible fluid such as a hydraulic oil. Likewise, if jacket 212a is used, the interior of jacket 212a is filled with oil. As oil is applied through port 232a, plunger 276a is extended. Piston 268a moves with plunger 276a, and so zone 277a enlarges, and air or other compensating fluid enters zone 277a through vent 279a. Zone 275a is compressed, forcing oil through ports 271a and 232b to the next stage of the tandem jack system. Since the area of the upper surface of cylinder 210a defined by annular zone 275a is equal to the area of the interior of the top surface of plunger 276b, the amount of oil passes from zone 275a to jack stage 200b is sufficient to extend plunger 276b by the same distance that plunger 276a is extended. Each intermediate stage 200b, . . . 200(n−1) is extended in a like manner by a like amount. The final stage 200n receives oil from the preceeding stage 200(n−1) and this oil causes plunger 276n to extend by a like amount. Likewise, withdrawal of oil through port 232a causes all the stages 200a . . . 200n to retract.

In some applications, it may be desirable to support a jack from a surface from which the jack extends in a downward direction. FIG. 12 schematically depicts telescoping hydraulic jack 350 which has first closed end 351 of its fixed, hollow plunger 352 attached to support structure 354. Fluid port 362 passes through the sidewall of plunger 352 adjacent support surface 354. Sleeve 356 telescopingly encloses plunger 352, and annular zone 361 is defined between the exterior surface of the sidewall of plunger 352 and the interior surface of the sidewall of sleeve 356. Piston 358 is connected to the lower end of plunger 352 and engages the interior surface of the sidewall of sleeve 356. Fluid port 360 is provided through the sidewall of the plunger 352 adjacent piston 358. Seals 364 are provided to slidingly seal the upper end wall 357 of sleeve 356 to the exterior surface of the sidewall of plunger 352 and to slidingly seal piston 358 to the interior surface of the sidewall of sleeve 356. Cylinder 366 telescopingly encloses sleeve 356. Piston 368 is connected to the lower end of sleeve 356 and engages the interior surface of the sidewall of cylinder 366, and zone 369 is defined within sleeve 372 and between pistons 358 and 368. Annular zone 371 is defined between the exterior surface of sidewall of sleeve 356 and the interior surface of the sidewall of cylinder 366. Fluid port 370 is provided through the sidewall of sleeve 356 adjacent piston 368, providing fluid communication between zone 369 and zone 371. Seals 372 slidingly seal the upper end wall 367 of cylinder 366 to the exterior surface of the sidewall of sleeve 356 and slidingly seal piston 368 to the interior surface of the sidewall of cylinder 366. The elevator car or other load 374 to be moved is attached to the lower end of cylinder 366. Vent 376 is provided through the sidewall of cylinder 366 adjacent the load 374.

To extend the hydraulic jack 350, and thus to lower elevator car 374, oil from the interior of plunger 352 is withdrawn through port 362. As a consequence, oil is drawn from annular zone 361, through port 360 to the interior of plunger 352. As a consequence, zone 361 decreases in size, drawing upper end wall 357 of sleeve 356 toward fixed piston 358 of plunger 352, thus extending sleeve 356 relative to plunger 352. As a consequence, zone 369 enlarges, and oil is drawn from zone 371 through port 370 to zone 369. This causes zone 371 to decrease in size, drawing upper end wall 367 of cylinder 366 toward piston 368 and thereby extending cylinder 366 relative to sleeve 356. Thus, the hydraulic jack is extended. Conversely to retract the hydraulic jack 350, oil is applied through port 362 to the interior of plunger 352. This oil passes through port 360 forcing the upper end wall 357 of sleeve 356 away from fixed piston 358, thereby retracting sleeve 356 on plunger 352. Zone 369 thus decreases in size, forcing oil from zone 369 through port 370 to zone 371. This forces upper end wall 367 of cylinder 366 away from piston 368, thereby retracting cylinder 366 on sleeve 356. Accordingly, the hydraulic jack 350 is extended downwardly and retracted upwardly from a fixed upper support 354.

FIG. 13 illustrates a further embodiment of telescoping hydraulic jack 400 in accordance with the present invention. Cylinder 402 is provided with fluid port 404 and is fixedly attached to a support surface 406. Sleeve 408 is telescoping enclosed within cylinder 402 and defines an annular zone 410 between the interior surface of the sidewall of cylinder 402 and the exterior surface of the sidewall of sleeve 408. Seal 412 slidingly seals bottom surface 414 of sleeve 408 to the interior surface of the sidewall of cylinder 402. Likewise, seal 416 slidingly seals the upper surface 418 of cylinder 402 to the exterior surface of the sidewall of sleeve 408. Hollow plunger 420 is telescopingly enclosed within sleeve 408, and annular zone 421 is defined between the exterior surface of the sidewall of plunger 420 and the interior surface of the sidewall of sleeve 408. Piston 424 closes the lower surface of plunger 420, and seal 422 slidingly seals piston 424 to the interior surface of the sidewall of sleeve 408. The upper surface of sleeve 408 is provided with a stop ring 425. Closed pipe 426 extends from piston 424 to upper surface 428 of plunger 420 to define hollow core 430 within plunger 420. Pipe 432 couples vent 434 from annular zone 410 to core 430. Seal 436 slidingly but sealingly engages piston 424 of plunger 420 against pipe 432. The crosssectional area of the upper surface 428 of plunger 420 defined by core 430 is equal to one half the area of upper surface 418 of cylinder 402 defined annular zone 410.

To extend telescoping hydraulic jack 400, oil is supplied through port 404. This acts against piston 424 of plunger 420 to extend the plunger, and oil is drawn into core 430 from annular zone 410. Because zone 410 is of twice the cross sectional area as is zone 430, the oil required to fill zone 430 as it extends a given distance requires shortening of zone 410 by one half that distance. Thus, sleeve 408 is restrained, and so plunger 420 extends relative to cylinder 402 at twice the rate that sleeve 408 extends relative to cylinder 402. To retract hydraulic jack 400, oil is withdrawn through port 404, thus retracting plunger 420. The oil within core 430 passes through pipe 432 to zone 410 in which it forces lower surface 414 of sleeve 408 away from upper surface 418 of cylinder 402 thereby retracting sleeve 408 into cylinder 402. Because zone 410 is of twice the cross-sectional area as is core 430, sleeve 408 retracts at one half the rate of plunger 420. If hydraulic jack 400 is of a relatively small size, pipe 426 can be omitted, so long as the cross-sectional area of the zone above piston 424 is equal to one half the area of upper surface 418 defined by annular zone 410. If desired cylinder 402 can be within a jacket in the same manner depicted in FIGS. 6–10.

FIG. 14 depicts another embodiment of telescoping hydraulic jack 450 in accordance with the present invention in which the upward movement of the sleeve is retarded by an arrangement inside the plunger so as to avoid the necessity of having a finished surface as the interior surface of sidewall of the cylinder. As a consequence, the cylinder can be formed of an ordinary steel pipe without a machine finished surface, thereby considerably reducing its cost. Jack 450 includes a cylinder 452 having a fluid port 454. Rod 456 extends upwardly along the central axis of cylinder 452 from closed bottom surface 458 of the cylinder. Piston 460 is connected to the upper end of rod 456. Sleeve 462 is telescopingly enclosed within cylinder 452. Seal 464 slidingly seals the upper surface 466 of cylinder 452 to the exterior surface of the sidewall of sleeve 462. Sleeve 462 is provided with a closed lower surface 468 through which rod 456 passes, and seal 470 slidingly seals surface 468 against rod 456. Sleeve-retarding cylinder 472 extends upwardly from lower surface 468 to engage piston 460. Annular zone 473 is defined by sleeveretarding cylinder 472 around rod 456. A suitable sliding seal 474 is provided at the junction of sleeve retarding cylinder 472 and piston 460. Plunger 478 is telescopingly enclosed within sleeve 462. Plunger 478 has a closed lower surface 479. Annular zone 463 is defined between the interior sidewall of sleeve 462 and the exterior sidewall of plunger 478. Port 476 is provided through sleeve-retarding cylinder 472 adjacent lower surface 468 of sleeve 462 to permit fluid communication between annular zone 463 and annular zone 473. Preferably the cross-sectional area of annular zone 463 is equal to the cross-sectional area of annular zone 473. Elevator car 480 or other load is supported on upper surface 482 of plunger 478. Seal 484 slidingly seals closed lower surface 479 of plunger 478 to the exterior surface of the sidewall of sleeve-retarding cylinder 472, and seal 488 slidingly seals the upper surface of sleeve 462 to the exterior surface of the sidewall of plunger 478. A vent 486 is provided adjacent upper surface 482 of plunger 478. Preferably, a strengthened bearing surface is provided adjacent the upper surface of sleeve 462 encircling plunger 478 and adjacent the upper surface of cylinder 452 encircling the sidewall of sleeve 462 to reduce sway and to provide more stable operation. Initially, the interior of cylinder 452 outside of sleeve 462 is filled with oil, annular zone 463 is filled with oil, and annular zone 473 is filled with oil.

To extend telescoping hydraulic jack 450, oil is provided through port 454, extending sleeve 462 from cylinder 452. The oil within annular zone 463 causes plunger 478 to be extended relative to cylinder 452 as sleeve 462 is extended. The upward movement of surface 468 decreases with the size of annular zone 473. As a consequence, oil within zone 473 passes through port 476 to zone 463 to act against plunger 478, causing the plunger to extend relative to sleeve 462 at the same rate that sleeve 462 extends from cylinder 452. Accordingly, plunger 478 extends from cylinder 452 at twice the rate as does sleeve 462. To retract telescoping hydraulic jack 450, oil is drawn through port 454 from the interior of cylinder 452. This retracts sleeve 462 into cylinder 458, and the enlarging volume of zone 473 draws oil from zone 463 through port 476. As a consequence, plunger 478 is retracted into sleeve 462.

If desired, rod 456 can be hollow with a port through its sidewall adjacent bottom surface 458 and a port through its upper end and through piston 460, with vent 486 closed. Then the exterior of rod 456 and the interior of plunger 478 are filled with oil, and the oil entering the interior of cylinder 452 through port 454 applies pressure through the oil within rod 456 and within plunger 478 to directly extend the plunger, in addition to the pressure applied through the oil in zones 463 and 473, as described above with reference to FIG. 14. Again, an oil jacket can be utilized, if desired.

Although the present invention has been described with reference to preferred embodiments, numerous modifications and rearrangements could be made, and still the result would be within the scope of the invention. What is claimed is:

1. A telescoping hydraulic jack comprising:

(a) an elongated plunger member having a closed sidewall;

(b) an elongated sleeve member telescopingly enclosing said plunger member and including:

(1) a sleeve head slidingly but sealingly engaging said plunger member sidewall;

(2) a sleeve sidewall having a first end, closed by means including said sleeve head, and a second end and having at least one fluid port therethrough adjacent said sleeve sidewall second end; and (3) a sleeve closure member attached to said sleeve sidewall to close the second end thereof;

(c) an elongated cylinder member telescopingly enclosing said sleeve member and including a cylinder head slidingly but sealingly engaging said sleeve sidewall, and a cylinder sidewall having a first end, closed by means including said cylinder head, and a second end;

(d) means slidingly sealing said sleeve sidewall to said cylinder sidewall between said sleeve sidewall fluid port and said sleeve sidewall second end;

(e) a jacket member encircling said cylinder sidewall and including:

(1) a closed jacket sidewall having a first end and a second end;

(2) a jacket head having a first portion attached to said jacket sidewall adjacent the first end thereof, a second portion attached to said cylinder sidewall, and a seal portion cooperating with said jacket head first and second portions to sealingly couple said jacket member and said cylinder member while permitting limited angular movement therebetween and inhibiting longitudinal movement therebetween in at least one longitudinal direction; and (3) a jacket closure portion attached to said jacket sidewall to close the second end thereof; and (f) means for supplying hydraulic fluid to and withdrawing hydraulic fluid from the interior of said jacket member.

2. A telescoping hydraulic jack as claimed in claim 1 in which said cylinder member further includes a cylinder closure member attached to said cylinder sidewall to close the second end thereof, at least one of said cylinder sidewall and said cylinder closure member having a least one fluid port therethrough.

3. A telescoping hydraulic jack as claimed in claim 2 in which said sleeve member includes means cooperating with the at least one cylinder member fluid port to restrict flow of hydraulic fluid through said at least one cylinder member fluid port to slow the rate of telescoping of said sleeve member into said cylinder member as said sleeve member reaches a position fully withdrawn into said cylinder member.

4. A telescoping hydraulic jack as claimed in claim 3 in which said cylinder head includes means cooperating with the at least one sleeve sidewall fluid port to restrict flow of hydraulic fluid through said at least one sleeve sidewall fluid port to slow the rate of telescoping of said sleeve member out from said cylinder member as said sleeve member reaches a position fully extended from said cylinder member.

5. A telescoping hydraulic jack as claimed in claim 1 in which said jacket member and said cylinder member include first means cooperating to angularly align said cylinder member within said jacket member.

6. A telescoping hydraulic jack as claimed in claim 5 in which said first cooperating means comprises a plurality of ear members extending inwardly from the interior of said jacket sidewall adjacent the jacket closure member and angularly spaced about said jacket sidewall and a lip member extending from the exterior of said cylinder sidewall second end.

7. A telescoping hydraulic jack as claimed in claim 6 in which said cylinder member and said sleeve member include second means cooperating to angularly align said sleeve member within said cylinder member.

8. A telescoping hydraulic jack as claimed in claim 7 in which said second cooperating means comprises a first ring member on the exterior surface of said sleeve sidewall adjacent the second end thereof, and a second ring member on the interior surface of said cylinder sidewall adjacent the second end thereof.

9. A telescoping hydraulic jack as claimed in claim 8 in which said cylinder member further includes a cylinder closure member attached to said cylinder sidewall adjacent the second end thereof, said cylinder sidewall and said second ring member having at least one fluid port therethrough, said first ring member cooperating with said second ring member to restrict flow of hydraulic fluid through said at least one fluid port to slow the rate of telescoping of said sleeve member into said cylinder member as said sleeve member reaches a position fully withdrawn into said cylinder member.

10. A telescoping hydraulic jack as claimed in claim 7 in which said sleeve member and said plunger member include third means cooperating to angularly align said plunger member within said sleeve member.

11. A telescoping hydraulic jack as claimed in claim 1 in which said cylinder member and said sleeve member include means cooperating to angularly align said sleeve member within said cylinder member.

12. A telescoping hydraulic jack as claimed in claim 11 in which said cooperating means comprises a first ring member on the exterior surface of said sleeve sidewall adjacent the second end thereof, and a second ring member on the interior surface of said cylinder sidewall adjacent the second end thereof.

13. A telescoping hydraulic jack as claimed in claim 1 in which said sleeve member and said plunger member include means cooperating to angularly align said plunger member within said sleeve member.

14. A telescoping hydraulic jack as claimed in claim 1 in which said cylinder head includes means cooperating with the at least one sleeve sidewall fluid port to restrict flow of hydraulic fluid through said at least one sleeve sidewall fluid port to slow the rate of telescoping of said sleeve member out from said cylinder member as said sleeve member reaches a position fully extended from said cylinder member.

15. A telescoping hydraulic jack as claimed in claim 1 in which said sleeve closure member has a check valve therein preventing fluid flow therethrough from the interior of said sleeve member to the exterior of said sleeve member adjacent said sleeve closure member, while permitting fluid flow therethrough from the exterior of said sleeve member adjacent said sleeve closure member to the interior of said sleeve member so long as the fluid pressure on the exterior of said sleeve member adjacent said sleeve closure member exceeds the fluid pressure on the interior of said sleeve member by a preset amount.

16. A telescoping hydraulic jack as claimed in claim 1 in which said jacket head first portion includes a first spherical surface and said jacket head second portion includes a second spherical surface engaging said first spherical surface to permit limited angular movement between said jacket member and said cylinder member.

17. A telescoping hydraulic jack as claimed in claim 16 in which said first spherical surface is beneath said second spherical surface.

18. A telescoping hydraulic jack as claimed in claim 1 in which said cylinder head is connected to said cylinder sidewall first end.

19. A telescoping hydraulic jack as claimed in claim 1 in which said cylinder head is resiliently connected to said jacket head.

20. In a hydraulic elevator including a plunger member, a sleeve member telescopingly enclosing said plunger member, a cylinder member telescopingly enclosing said sleeve member, and means for supplying hydraulic fluid to and withdrawing hydraulic fluid from the interior of said cylinder member to telescope said sleeve member out from and into said cylinder member and said plunger member out from and into said sleeve member, the improvement in which said means for supplying and withdrawing hydraulic fluid comprises a jacket member encircling said cylinder member and including a closed jacket sidewall having a first end and a second end, a jacket head member having a first portion attached to said jacket sidewall adjacent the first end thereof, a second portion attached to said cylinder sidewall, and a seal portion cooperating with said jacket head first and second portions to sealingly couple said jacket member and said cylinder member while permitting limited angular movement therebetween and inhibiting longitudinal movement therebetween in at least one longitudinal direction, a jacket closure portion attached to said jacket sidewall to close the second end thereof, and means for supplying hydraulic fluid to and withdrawing hydraulic fluid from the interior of said jacket member.

21. A telescoping hydraulic jack comprising:

(a) an elongated plunger member having a first end adapted for attachment to a load, a sidewall, and a second end;

(b) means closing said plunger member second end;

(c) an elongated sleeve member telescopingly enclosing said plunger member to define a first annular zone therebetween, and including:

(1) a first end portion slidingly but sealingly engaging said plunger member sidewall;

(2) a sidewall having a first end, closed by means including said sleeve member first end portion, and a second end;

(3) a second end portion;

(d) means including said sleeve member second end portion for substantially closing said sleeve member sidewall second end;

(e) one of said plunger member sidewall first end and said sleeve member sidewall second end having a fluid port therethrough;

(f) an elongated cylinder member telescopingly enclosing said sleeve member and including:

(1) a first end portion slidingly but sealingly engaging said sleeve member sidewall;

(2) a sidewall having a first end, closed by means including said cylinder member first end portion, and a second end;

(3) a second end portion;

(g) means including said cylinder member second end portion for substantially closing said cylinder member sidewall second end;

(h) one of said cylinder member sidewall and said cylinder member second end portion having a fluid port therethrough;

(i) means responsive to telescoping of said sleeve member out from and into said cylinder member for supplying hydraulic fluid to and withdrawing hydraulic fluid from the interior of said sleeve member outside said plunger member to cause telescoping of said plunger member out from and into said sleeve member;

(j) means slidingly sealing said sleeve member sidewall second end to said cylinder member;

(k) a jacket member encircling said cylinder member sidewall and including:

(1) a closed jacket sidewall having a first end and a second end;

(2) a jacket head having a first portion attached to said jacket sidewall adjacent the first end thereof, a second portion attached to said cylinder member sidewall, and a seal portion cooperating with said jacket head first and second portions to sealingly couple said jacket member and said cylinder member while permitting limited angular movement therebetween and inhibiting longitudinal movement therebetween in at least one longitudinal direction; and (3) a jacket closure portion attached to said jacket sidewall to close the second end thereof; and (l) means for supplying hydraulic fluid to and withdrawing hydraulic fluid from the interior of said jacket member.

22. A telescoping hydraulic jack as claimed in claim 21 in which said jacket member and said cylinder member include means cooperating to angularly align said cylinder member within said jacket member.

23. A telescoping hydraulic jack as claimed in claim 21 in which said cylinder member and said sleeve member include means cooperating to angularly align said sleeve member within said cylinder member.

24. A telescoping hydraulic jack as claimed in claim 21 in which said sleeve member and said plunger member include means cooperating to angularly align said plunger member within said sleeve member.

25. A telescoping hydraulic jack as claimed in claim 21 in which said jacket head first portion includes a first spherical surface and said jacket head second portion includes a second spherical surface engaging said first spherical surface to permit limited angular movement between said jacket member and said cylinder member.

26. A telescoping hydraulic jack as claimed in claim 25 in which said first spherical surface is beneath said second spherical surface.

27. A telescoping hydraulic jack as claimed in claim 21 in which said cylinder head is connected to said cylinder sidewall first end.

28. A telescoping hydraulic jack as claimed in claim 21 in which said cylinder head is connected to said jacket head.

29. A telescoping hydraulic jack as claimed in claim 21 in which said sleeve member includes a check valve preventing fluid flow therethrough from the interior of said sleeve member to the exterior of said sleeve member, while permitting fluid flow therethrough from the exterior of said sleeve member within said first cylinder member to the interior of said sleeve member so long as the fluid pressure on the exterior of the sleeve member within said first cylinder member exceeds the fluid pressure on the interior of said sleeve member by a preset amount.

* * * * *